United States Patent [19]

Holmberg

[11] Patent Number: 4,975,011

[45] Date of Patent: Dec. 4, 1990

[54] SOLVENT ACTIVATED BINDABLE SHEET AND METHOD AND APPARATUS FOR PRODUCING BOUND BOOKLETS

[76] Inventor: Albert E. Holmberg, 5923 Abbott Ct., Minnetonka, Minn.

[21] Appl. No.: 413,246

[22] Filed: Sep. 27, 1989

[51] Int. Cl.[5] ..... B42C 9/00

[52] U.S. Cl. ..... 412/6; 412/8; 281/15.1; 281/38

[58] Field of Search ..... 412/1, 6, 8, 9, 33, 412/20, 37, 900; 281/15.1, 38; 156/305, 227, 308.6, 308.8

[56] References Cited

U.S. PATENT DOCUMENTS 3,707,418 12/1972 Bhagat et al. ..... 412/37
4,213,220 6/1980 Lopex-Martinez ..... 412/8
4,453,997 6/1984 Hori et al. ..... 156/305
4,473,425 9/1984 Baughman et al. ..... 412/37
4,525,116 6/1985 Holmberg ..... 412/8
4,673,324 6/1987 Hanson et al. ..... 156/227

*Primary Examiner*—Paul A. Bell
*Assistant Examiner*—Hwei-Siu Payer
*Attorney, Agent, or Firm*—John W. Adams

[57] ABSTRACT

A prefabricated bindable sheet having a solvent-responsive glue applied along one edge thereof to permit the sheet to be quickly and easily bound to another sheet wherein the glue is not responsive to heat for activation and the method for binding a plurality of sheets together and including a double sheet with a center fold-line having solvent activated ribbon of glue applied to the double sheet on both sides of the fold line.

9 Claims, 1 Drawing Sheet

SOLVENT ACTIVATED BINDABLE SHEET AND METHOD AND APPARATUS FOR PRODUCING BOUND BOOKLETS

BACKGROUND OF THE INVENTION

This invention is closely related to my prior U.S. Pat. No. 4,525,116 issued June 25, 1985 and entitled PREFABRICATED BINDABLE SHEET AND BINDING METHOD AND APPARATUS of which I am the record owner.

My prior invention disclosed a heat responsive glue for binding multiple sheets together along one edge thereof after the appropriate printed material has been applied to each of the sheets. Frequently, the printed material is applied by means of a conventional copying machine which produces heat during the copying process. The problem is that a heat responsive glue will be activated during copy machine processing which makes the sheets unusable in such machines.

SUMMARY OF THE INVENTION

The present invention eliminates the heat responsive glue by using a solvent responsive glue which will be activated only by the appropriate solvent to which the glue responds. In one form of the invention the solvent used is water in a spray form to activate the edge applied glue strip which remains passive and non-adhesive until the solvent is applied thereto.

DETAILED DESCRIPTION OF THE PREFERRED EMBODIMENT

Figure 3:
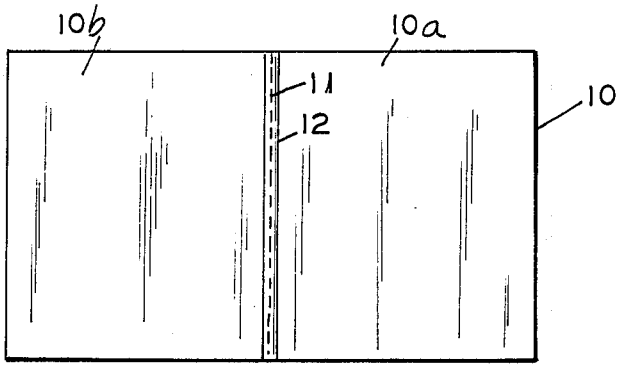
FIG. 3 is a front elevational view of an open single sheet embodying the invention; and, FIG. 4 is a diagrammatic view of a device for binding assembled sheets together.

A double sheet 10 embodying individual sheets **10*a* and 10*b* is illustrated in FIG. 3 and is provided with a fold line 11 and a ribbon 12 of conventional solvent-activated glue which is not affected by the dry heat of a conventional copying machine or any other application of heat. Information may be applied to the sheet in any conventional manner such as by a heat-activated copying machine, a typewriter, or a conventional printing process, or in any other conventional manner. After the informational data has been applied to the double page sheet 10, the sheet is folded along the fold line 11. The double sheets then may be quickly and easily bound together along the glue edges thereof by merely applying a glue-activating solvent such as water in the case of a water soluble glue, to the folded edges 11 of the sheets and then applying binding pressure to the sheet edges momentarily until the glue has dried. The solvent can be readily applied in vapor form to the edges of the sheets to be glued as by a suitable spray mechanism shown in FIG. 4** to permit the solvent vapor to activate the glue prior to pressing the sheets together with a glue-to-glue seal between adjacent sheets.

Figure 1:
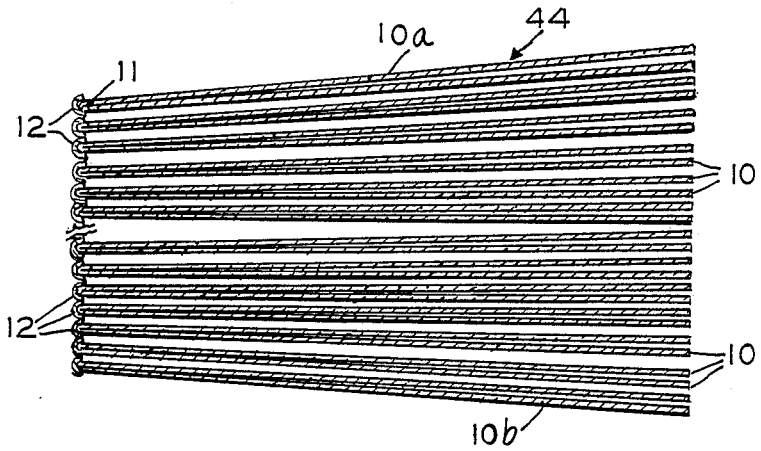
FIG. 1 is a vertical sectional view showing portions of a bound book embodying this invention.
Figure 2:
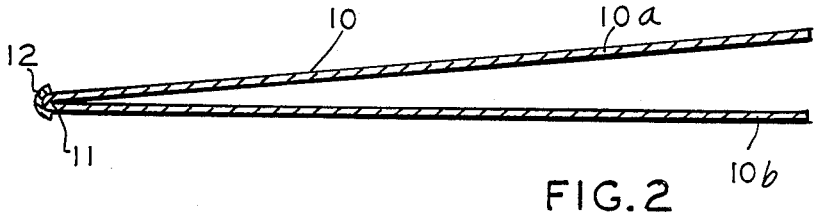
FIG. 2 is a vertical sectional view of a single folded sheet embodying this invention.

It will be seen that the glue surfaces 12 on opposite sides of the fold line 11 will form a positive connecting glue-to-glue adhesion with adjacent sheets, as best shown in FIG. 1. The outer individual sheets **10*a* and 10*b*** can serve as the cover sheets or in the alternative, a separate wrap around cover (not shown) may be provided, if desired.

Figure 4:
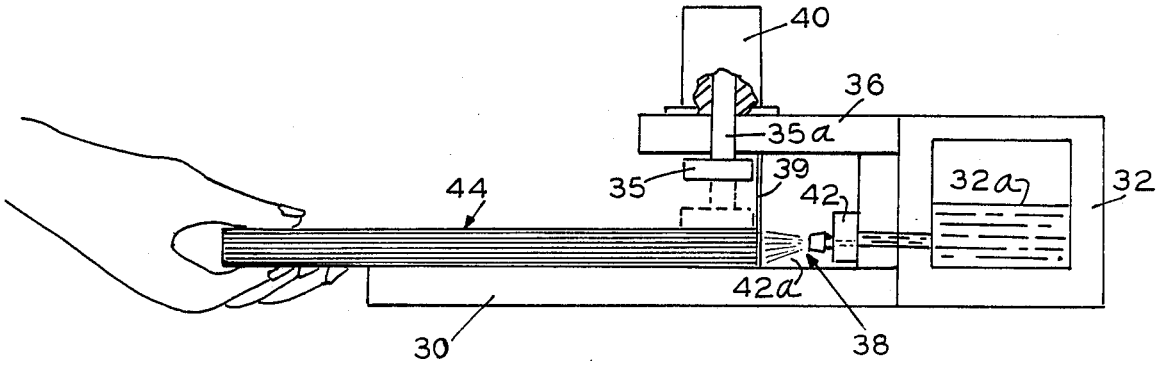

As best shown in FIG. 4 the sheets with the preapplied remoistable glue may be quickly and easily bound together by means of suitable apparatus designed to securely hold the sheets together with the glued edges thereof in the desired registered relationship.

An example of such apparatus is illustrated in FIG. 4 which includes a flat supporting base 30 having a tank 32 for confining a glue solvent **32*a*. A paper clamping member 35 is mounted in the desired relationship to the base 30 and includes a suitable guiding stem 35*a* which is slidably mounted on a support member 36 spaced from the base 30** as illustrated.

A glue activating station is provided on the base 30 in the desired relationship to the clamping member 35, as illustrated. The station is designated generally by the numeral 38 and is defined between the base 30 and the clamping member 35 as by suitable paper stop means such as a plurality of spaced apart wire elements 39 stretched tightly between the support member 36 and the base 30.

Suitable actuating means for moving the clamping member 35 into and clamping position are provided such as a solenoid mechanism 40 operatively associated with the clamping member 35, as illustrated. A valve member 42 controls the flow of liquid solvent from the tank 32 through the spray nozzles **42*a* directed toward the clamped, glued edges of the layers of paper 44 fed into the gluing station as shown. The valve member 42 may be actuated by a solenoid which is energized manually by a suitable switch connected through a time delay circuit to the clamping member so that the spray from the nozzles 42*a* is directed onto the registered glue edges of the paper before the clamping member leaves its retracted position shown by full lines shown in FIG. 4 and begins its travel toward a stack of paper 44** so that the glue solvent is applied to the glue on the paper edges immediately before the edges are tightly clamped together by the actuated clamping member.

It will be seen that this invention provides a highly efficient method and apparatus for gluing a plurality of sheets, together by activating a solvent responsive glue applied to the edges of the paper sheets having the glue preapplied thereto.

What is claimed is:

1. A plurality of bound-together double sheets comprising at least two double sheets bound together, each sheet including:

a center fold line, a ribbon of solvent-activated adhesive applied on both sides of said fold line of each of the double sheets adjacent thereto so that when the sheets are folded along said fold line, the adhesive will be exposed on the outside thereof and on both sides of said fold line, whereby activation of the adhesive by application of a solvent will permit at least two double sheets to be securely bound together in adhesive-to-adhesive relationship while providing an unrestricted hinge connection between individual sheets of said bound-together double sheets.

2. The structure set forth in claim 1 wherein the adhesive is water-activated.

3. The method of producing a plurality of sheets to be glued together comprising, providing a plurality of large sized sheets, producing a fold line dividing each large sheet into two smaller sheets and applying a solvent-responsive glue to the smaller sheets adjacent the fold line on both sides of the fold line.

4. The method set forth in claim 3 and dividing each large size sheet by a fold line into two similar sized sheets one-half the size of the large sheet.

5. The method set forth in claim 3 and providing information on said sheets by means of a conventional copying machine which includes the application of heat in the copying process.

6. The method of binding a plurality of sheets together comprising, providing a plurality of sheets having a solvent-responsive glue applied along one edge thereof, positioning the glue containing edges of the sheets in registration with each other, applying a solvent to the registered glue containing edges, and clamping the glue-containing edges of the sheets together in glue-to-glue relationship with the glue is still activated to produce a plurality of sheets bound together along one edge.

7. The method set forth in claim 6 wherein the applying step further comprises the step of spraying the solvent onto the glue-containing edges using a spraying apparatus.

8. The method of binding a plurality of sheets together comprising, providing a plurality of sheets to be bound together, applying solvent-responsive glue to the edges of the sheet, positioning the sheets in the desired orientation with the edges to be glued in registered loosely spaced apart relation, directing a spray of solvent in vapor form against the glue edges to permit penetration of the solvent onto the glue, and pressing the activated glue edges of the sheets together to form a bound multi-sheet book.

9. The method of producing a plurality of bound sheets comprising, providing a plurality of large sized sheets, producing a fold line dividing each large sheet into two smaller sheets, applying a solvent-responsive glue to the smaller sheets adjacent the fold line on both sides of the fold line, applying solvent to the glue to activate the same and binding the sheets together in glue-to-glue relationship after activation of the glue.

* * * * *